United States Patent [19]

Salerni et al.

[11] Patent Number: 4,611,658

[45] Date of Patent: Sep. 16, 1986

[54] HIGH PRESSURE RETRIEVABLE GRAVEL PACKING APPARATUS

[75] Inventors: John V. Salerni, Kingwood; Rodney J. Wetzel, The Woodlands, both of Tex.

[73] Assignee: Baker Oil Tools, Inc., Orange, Calif.

[21] Appl. No.: 654,142

[22] Filed: Sep. 26, 1984

[51] Int. Cl.[4] ..... E21B 33/128; E21B 33/129

[52] U.S. Cl. ..... 166/134; 166/51; 166/120; 166/138; 166/196; 277/116.2; 277/120; 277/188 A; 277/230

[58] Field of Search ..... 166/51, 120, 123, 134, 166/138, 181, 196; 277/30, 116.2, 117-122, 188 A, 230; 285/140, 141

[56] References Cited

U.S. PATENT DOCUMENTS

| | | | |
|---|---|---|---|
| 3,398,795 | 8/1968 | Elliston | 166/123 X |
| 3,987,854 | 10/1976 | Callihan et al. | 166/51 X |
| 4,289,200 | 9/1981 | Fisher, Jr. | 166/120 |
| 4,326,588 | 4/1982 | McStravick | 166/134 X |
| 4,487,258 | 12/1984 | Jackson et al. | 166/120 |
| 4,505,332 | 3/1985 | Mills et al. | 166/120 |

*Primary Examiner*—Stephen J. Novosad
*Assistant Examiner*—John F. Letchford
*Attorney, Agent, or Firm*—Norvell & Associates

[57] ABSTRACT

A retrievable well packer and gravel packing system employing a multi-component packing element system is disclosed. The packing element system is expandable under axial compression to seal the annulus between a production or treatment tubing string and the well casing. The packing element system includes outer elastically deformable anti-extrusion backup rings and a central primary seal. A resilient member conformable to the surrounding countour, such as wire mesh, is employed between the central primary seal and each backup ring to allow retraction of the backup rings for retrieval.

4 Claims, 20 Drawing Figures

HIGH PRESSURE RETRIEVABLE GRAVEL PACKING APPARATUS

BACKGROUND OF THE INVENTION

1. Field of the Invention

This invention relates to retrievable well tools used in subterranean oil and gas wells under extreme conditions of temperature and pressure and more particularly to packing element systems employed on well tools, such as retrievable packers, bridge plugs and gravel packing tools.

2. Description of the Prior Art

Downhole well tools, employed in subterranean oil and gas wells are normally intended either for permanent installation within the well bore or are of the retrievable type which may be inserted into the well bore and subsequently removed. For example, downhole packers commonly used to establish a seal in the annulus between the well casing and a smaller diameter production tubing string inserted into the casing can be intended either for permanent installation or for subsequent retrieval. Permanent well packers can be set at a desired location within the well bore by means of mechanical tubing or wireline manipulation or by the use of hydraulic or hydrostatic pressure to set the permanent packer. Retrievable packers can also be set by hydraulic or mechanical manipulation. Retrievable packers can also be released by either mechanical or hydraulic manipulation. For example, retrievable packers are commonly released by manipulation of a retrieving tool inserted into the bore of the retrievable packer on a tubing extending to the surface of the well.

Once a permanent packer has been set at the prescribed location within the well, it can only be removed by milling or drilling the packer, thus destroying the packer. A conventional permanent packer cannot be returned to the surface of the well in substantially one piece to be redressed for further use. Retrievable packers can be redressed after retrieval and are suitable for further use.

In general, permanent packers are suitable for use at higher temperatures and pressures than comparable retrievable packers. One reason for the higher temperature and pressure ratings which can be achieved with permanent packers is that permanent packers have hitherto been designed with a greater capability for resisting extrusion of the packing element. Both permanent and retrievable packers are normally inserted with a well bore with adequate clearance between the packer and the well bore to avoid interference as the packer is run into the well. When the packer is set, radially expandable slips are actuated and moved into engagement with the well casing. An annular seal or packing element commonly fabricated of a resilient or elastomeric material is expanded into engagement of the well casing in response to axial compression exerted on the packing element. The clearance between the housing of the packer or well tool and the well casing provides an annular area into which the packing element, subjected to axial compression, can extrude.

In permanent packers, bridging or extrusion preventing rings formed of a malleable metallic material, are commonly employed to prevent extrusion into the area between the packer housing and the well casing. These metallic extrusion preventing rings are expandable into engagement in the casing upon the application of an axially compressive force sufficient to expand the packing element into sealing engagement with the casing. These extrusion preventing rings effectively seal off all, or a portion of, the annular clearance area and are of a sufficient strength to withstand both extreme pressures applied to the packer and to prevent extrusion of the packing material subjected to extreme temperatures. Outward expansion of the extrusion preventing rings brings them into engagement with the casing and prevents subsequent removal of the packer unless the rings can be retracted. Some extrusion preventing rings are plastically deformed when the packer is set. These plastically deformed extrusion preventing rings thus lack sufficient elastic memory to retract from engagement with the casing when axially compressive loads are removed.

Even if the extrusion preventing rings retain inherent elasticity, retraction of the rings is prevented if the packing element has been permanently deformed. Such permanent deformation can occur when the resilient material comprising the packing element has taken on a permanent set upon being subjected to elevated temperature and pressure for a certain period of time. The packing element can thus wedge the extrusion preventing means in such a manner that retraction of even an elastic extrusion ring is prevented by engagement with the permanently set sealing element. The extrusion preventing rings can also be permanently wedged into engagement with the casing when the structure of the packing element has been deformed by fracture under elevated temperatures and pressure. For example, the radial expansion of extrusion preventing rings often leaves a circumferential gap between adjacent segments or ends of the extrusion preventing ring. When subjected to elevated temperatures and pressures, particularly for a sustained period of time, the material forming the packing element will extrude through these circumferential gaps. Extrusion through these gaps will be accompanied by a destruction of the molecular bonds of the resilient material forming the packing element, thus destroying the elastic memory of the packing element material. With the packing element material thus wedged in circumferential gaps separating adjacent elements of the extrusion preventing rings, these circular gaps cannot be closed and the extrusion preventing rings subsequently cannot be retracted out of engagement with the casing. Thus a packer employing extrusion preventing rings of the type formerly used on permanent packers could not be released from engagement with the well casing even if the anchoring slips holding the packer in place could be disengaged.

Only those retrievable packers employing extrusion rings capable of withstanding only small amounts of shear applied upon longitudinal movement of the packer body could heretofore be used with retrievable packers. For example, retrievable packers having plate-like extrusion preventing rings or shoes could be employed, since the relatively thin plates forming the extrusion barriers or shoes would be deformed or bent out of engagement with the casing upon application of sufficient force to the packer housing to cause the packer to move relative to the well casing. Of course, such relatively weak extrusion barriers or shoes could not withstand extreme temperature and pressure forces which can be encountered under certain conditions. Thus the normal practice is to use a permanent packer when extreme conditions in temperature and pressure are anticipated, especially when the packer is intended to be used for a protracted period of time.

U.S. Pat. No. 4,326,588 discloses one permanent packer intended for use under extreme conditions of temperature and pressure. The permanent packer disclosed therein employed a primary sealing element fabricated from a material such as polytetrafluoroethylene which has good chemical resistance. Wire mesh elements are disposed on opposite sides of the centrally located main sealing element to prevent extrusion of the main sealing element at elevated temperature and pressure. Radially expandable extrusion barrier rings of the type commonly employed on conventional permanent packers are also employed to further resist extrusion. U.S. Pat. No. 4,326,588 does not, however, provide means for retracting the packer from the well casing to permit retrieval. A retrievable packer capable of withstanding elevated temperature and pressure conditions, heretofore requiring the use of a permanent packer, and capable of disengagement from the well casing and retrieval is disclosed and claimed herein.

SUMMARY OF THE INVENTION

A well tool for use in the casing of a subterranean well under extreme conditions of temperature and pressure, comprises a packing element system having an initial outer diameter less than the inner diameter of the well casing for insertion through the casing. The packing element system includes a primary sealing capable of sealing the annulus element between the well tool and the casing at a subterranean location, at a differential pressure of at least 12,000 psi at a temperature of at least 350° F. The primary sealing element is radially expandable under axial compression. The well tool can be set at a subterranean location and axial compression can be applied to the packing element. When the axial compression on the packing element system is relieved and after the primary sealing element has been subjected to a differential pressure of at least 12,000 psi at a temperature of at least 350° F., the tool can be released. The well tool is then retrievable from the casing intact.

In addition to the primary sealing element, the packing element system includes backup rings on each end, expandable into engagement with the casing to prevent axial extrusion of the primary sealing element. A resilient element, which can be a wire mesh element, is disposed between the backup rings and the primary sealing element and is conformable to the contour of the primary sealing element and the backup rings. The resilient element enables the backup rings to retract, even when the primary sealing element is permanently deformed in the expanded condition, so that the well tool can be retracted.

BRIEF DESCRIPTION OF THE DRAWINGS

FIGS. 3A and 3B are longintudinal continuations showing the packer of FIGS. 1A and 1B in the released configuration and also showing a retrieving tool insertable within the bore of the packer for releasing of the packer from the well casing.

DETAILED DESCRIPTION OF THE PREFERRED EMBODIMENT

Figure 1A:
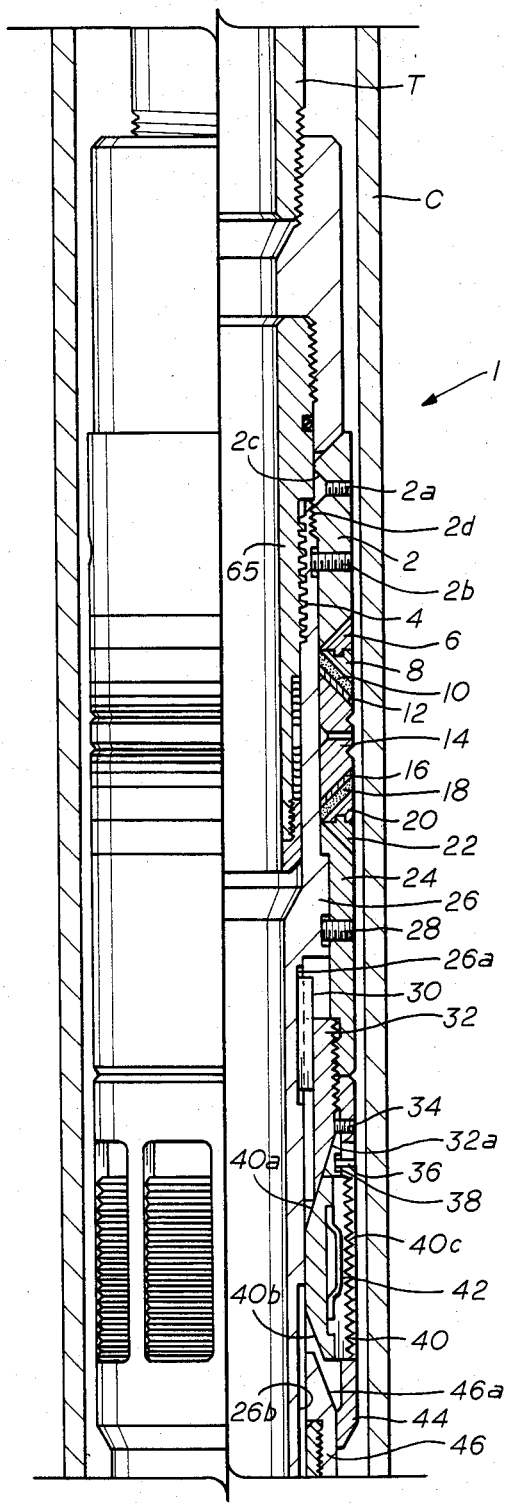
FIGS. 1A and 1B are longitudinal continuations of a retrievable packer shown in the retracted position in which the packer is inserted into the well bore, located adjacent the casing in the well bore.
Figure 1B:
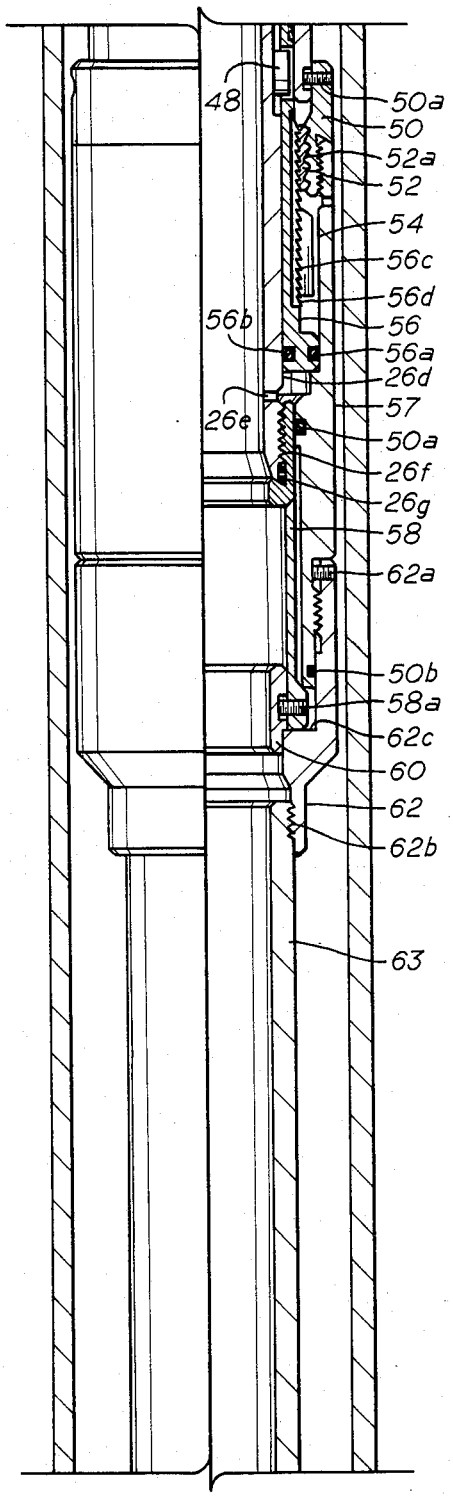

The packer 1 shown in FIGS. 1A and 1B is shown in the run-in configuration attached to tubing T extending to the well surface. FIG. 1B also shows additional tubing or tail pipe 63 attached to the lower end of the packer and run in at the same time the packer is inserted. In the embodiment shown in FIGS. 1A and 1B, the packer 1 is hydraulically set in response to an increase in fluid pressure within the tubing T. Tubing pressure in the packer bore and tubing T is generally increased by first dropping a ball into a ball seat below the packer 1. The ball will then close the tubing T permitting an increase in fluid pressure to set the packer 1. Conventionally a ball seat (not shown) having a shoulder for receiving the ball will be located below the packer, for example, in tubing 63. Normally a shearable ball seat will be used in which the ball will be positioned below the packer 1 as pressure is increased to a sufficient degree to set the packer. A further increase in fluid pressure within the tubing will shear the conventional shearable ball seat (not shown) thus allowing the ball and ball seat to drop through the tubing and/or tail pipe to provide an unrestricted bore through the packer and tubing after the packer 1 has been set.

As shown in FIGS. 1A and 1B, the preferred embodiment of the packer 1 comprises an uppermost outer setting sleeve 2 connected to mandrel or body 26 of the packer 1 by means of thread **2*d* and secured by pin 2*b*. Left hand square threads 4 are located on the inner surface of the mandrel or body 26 adjacent its upper end. These left hand square threads 4 are engageable with a cooperating latch member 65** attached to the tubing T extending thereabove.

Setting sleeve 2 comprises the upper portion of the exterior housing of packer 1. A packing element system consisting of a plurality of sealing and extrusion preventing elements are located in surrounding relationship to the mandrel 26 at the lower end of setting sleeve 2. The packing element system comprises an upper extrusion preventing barrier or back up structure comprising two split rings 6 and 8. Extrusion preventing rings 6 and 8 comprise elastically expandable members shiftable into engagement with the outer casing of the well. These elastic members are fabricated from a spring metal and are interfitted by tongue-and-groove configuration. A similar lower extrusion preventing barrier or back up ring assembly comprises two similarly interfitting elastic spring metal rings 20 and 22 at the lower end of the packing element system. A central packing element 14 is located between the upper and lower sets of back up rings. In the preferred embodiment of this invention, the central packing element comprises a molded sealing element for establishing sealing integrity between the packer and the external casing. In the preferred embodiment of this invention the central packing element comprising an element fabricated from a material such as polytetrafluoroethylene. This material provides excellent chemical resistence to corrosive materials often encountered in subterranean oil or gas wells, as well as providing excellent high temperature performance. Of course, the invention described here can be employed with a more conventional or elastomeric material, such as nitrile rubber.

Between upper backup rings and the central packing element 14, which provides the primary seal between the packer and the outer casing, an annular barrier element 10, which is transversely compressible, deformable and conformable to the contour of the extrusion preventing elements and axially and radially resilient, is positioned adjacent each extrusion preventing ring. The barrier elements form a low function interface with the backup rings. In the preferred embodiment of this invention, both the upper barrier element 10 and the lower barrier element 18 comprise transversely compressible seamless, knitted elements generally defined by a continuous series of interlocking ductile, metal-containing loop members. The construction of one embodiment of such resilient elements is described in U.S. Pat. No. 2,761,203 entitled Resilient Gasket Forming Material and Method of Producing Same and U.S. Pat. No. 3,033,722 entitled Compressable Metal Gasket and Method of Making Same, each being assigned to Metex Corporation of Edison, N.J. These elements 10 and 18 each consist of a continuous series of interlocking loops knitted in a tubular form, allowing two-way movement in the wire plane, affording unusual flexibility and resiliency, even under heavy compression loads and exposure to extreme temperatures. It has been found that knitted wire yields to applied force yet maintains its compressive stress. Since there are no ribs, seams or other weak areas in this construction, a uniform strength is maintained over its entire area. When used in combination with a basic sealing material, such as asbestos-laden cords interwoven between one or more of the loops, the knitted wire serves as a backup "sleeve or expander, imparting its resiliency to the combined elements. This seamless, knitted element can be compressed to the contour of an adjacent member, and it may be fabricated from almost any material or combination of materials that may be drawn in filament form, such as stainless steel wire, or other ductile metals, such as aluminum, copper and special alloys in combination with the asbestos-laden material, other synthetic fibers, polymers and yarns. In the preferred embodiment of this invention, the intertwined filaments are knitted. Such a knitted element is further disclosed in bulletin number Ml-50 of the Metex Thermal-Mechanical Group, Metex Corporation.

In the preferred embodiment of this invention, an additional element is located between the resilient wire element member and the central primary packing element 14. Elements 12 and 16 are fabricated from a material having a greater resistence to extrusion than the primary sealing element. For example, a polytretrafluoroethylene element having a larger percentage of fillers, such as glass filling, than the primary sealing element 14, can be used to fabricate elements 12 and 16.

A lower outer housing 24 engages the lower backup ring 22 below primary packing element 14. Lower housing 24 and setting sleeve 2 hold the packing element system positioned circumferentially around the mandrel body 26. A shear pin 28 holds the lower housing element 24 fixed relative to body 26. Mating shoulders also prevent upward movement of the inner body or mandrel 26 relative to the outer housing 24. Housing 24 is secured to slip cone 32 by means of conventional threads adjacent its lower end. Slip cage 44 is also attached to upper cone 32 along these same threads and in FIG. 1A is shown in abutment with the lower end of outer housing 24. Slip cage 44 has a plurality of radial openings through which a plurality of conventional one-piece slips 40 can be expanded. Springs 42 engaging the slips 40 and the slip cage 44 normally holds each of the slips in a retracted position. Each slip 40 has an inclined upper surface **40*a* and an inclined lower surface 40*b* on the interior thereof. The exterior of each slip 40 is defined by a serrated gripping surface. The upper inclined surface 40*a* is positioned opposite a cooperating upper slip cone surface 32*a*. The lower inclined surface 40*b* is similarly positioned in opposing relationship to an inclined slip surface 46*a* on a lower slip cone 46. Lower slip cone 46 is attached by means of pin 50*a* to a ratchet ring sub 50. Ratchet ring sub 50 carries an annular body lock ring 52 having ratcheting teeth on its inner and outer surface. The ratcheting ring 52 comprises a split ring which is held against radial expansion by ratchet ring sub 50. The ratcheting teeth 52*a* on the inner surface engages cooperating ratcheting teeth on an axially shiftable piston 56 located between the inner mandrel 26 and a lower outer housing section 57**.

The annular piston 56 is shiftable along and relative to the lower portion of mandrel 26. O-ring seals **56*a* and 56*b* establish sealing contact with both the outer surface of lower mandrel section 26*d* and the inner surface of the lower housing 57. Piston 56 thus moves within a presure chamber between the lower housing 57 and the inner mandrel 26. A radially extending port 26*e* is located at the lower end of inner mandrel body 26 and provides communication between the bore of the packer and the pressure chamber within which piston 56 is shiftable. A latching collet 58 is attached at the lower end of inner mandrel 26 below port 26*e* by means of a conventional threaded connection 26*f*. Latching collet 58 comprises a cylindrical member having a plurality of radially manipulatible collet arms terminating in an enlarged collet head at its lower end. An annular sleeve 60 secured to the collet head by means of a shear screw 58*a* holds the enlarged collet head in engagement with the lowermost shoulder of lower housing 57. A bottom sub 62 is attached to the lower end of lower housing 57 and comprises an upwardly facing shoulder 62*c* abutting the lower end of the collet head of latching collet 58. Thus the latching collet is held in position in engagement with the lower housing 57, the bottom sub 62, and the inner sleeve 60. As shown in FIG. 1B, a lower section of tubing or tail pipe 63 is attached by means of a conventional thread 62*b* to the bottom sub 62. The inner sleeve 60 is spaced from the tail pipe 63 and is similarly spaced from the upper cylindrical portion of the latching collet 58**.

Rotation between the inner mandrel 26 and the slip cones 32 and 46 is prevented by cooperating keys 30 and 48 received within slots in the inner mandrel 26, in the cones 32 and 46, and in piston 56. Thus the packer can be set in conventional fashion by means of relative axial movement between the inner mandrel 26, the slips 40, the packing element 14, and the outer housing 24.

Figure 2A:
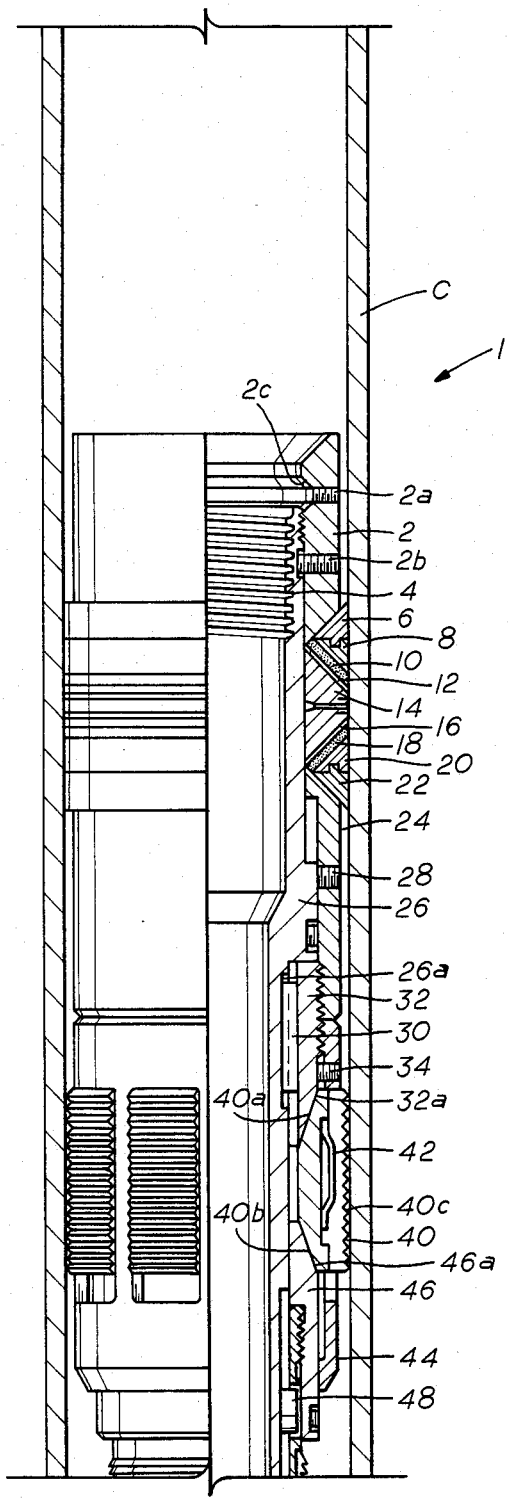
FIGS. 2A and 2B are longitudinal continuations similar to FIGS. 1A and 1B showing the packer in the anchored and set position sealing the annulus between the packer and the well casing.
Figure 2B:
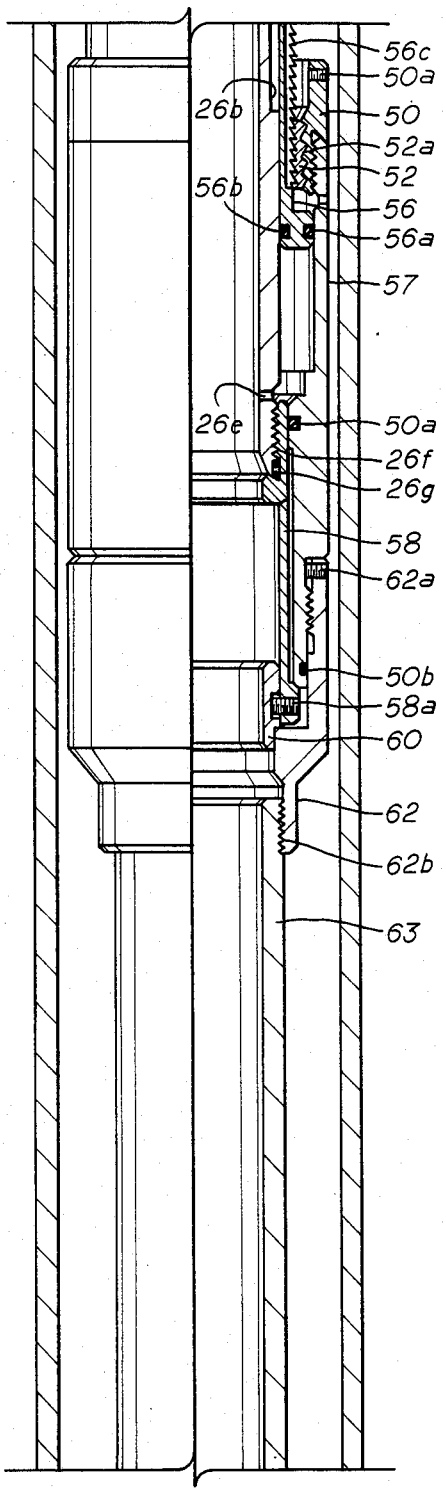
Figure 1A:
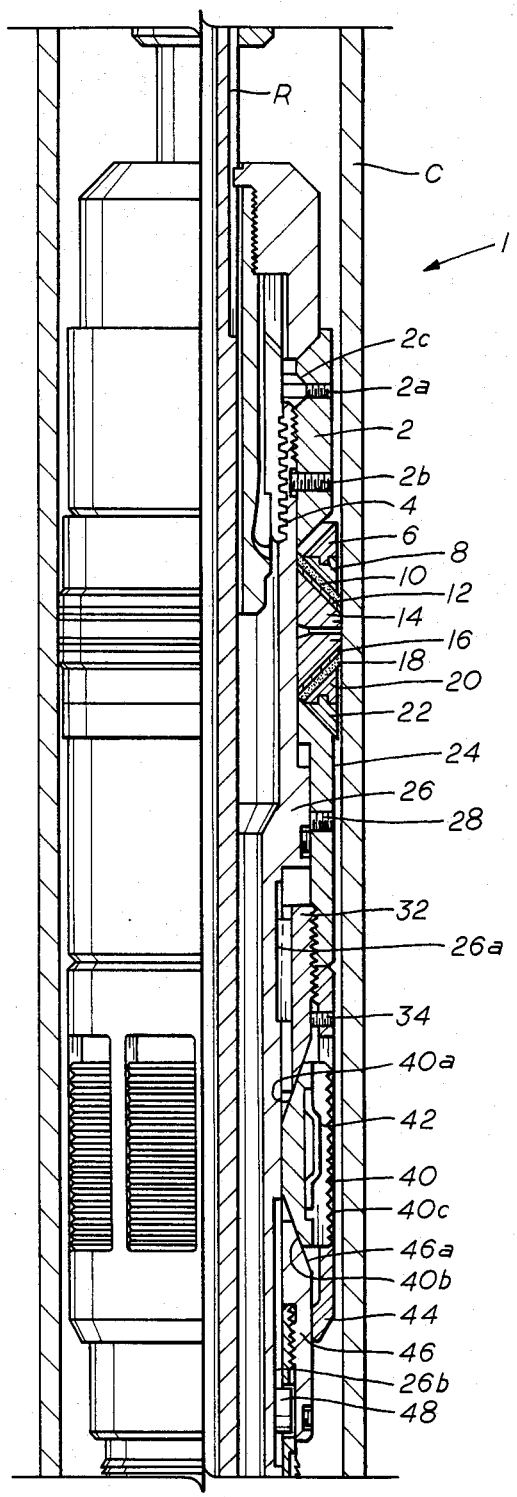
Figure 1B:
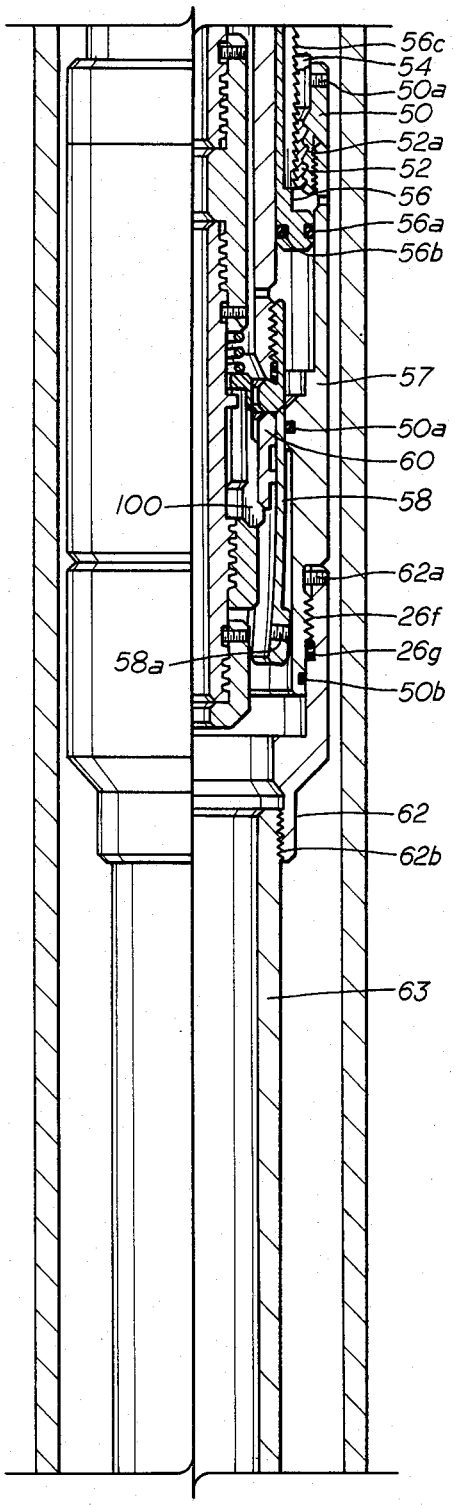

FIG. 2 shows the packer 1 in the set configuration with the tubing string extending to the surface of the well removed. Note that the packing element system including the extrusion preventing backup rings 6, 8, 20 and 22; the resilient elements 10 and 18 and the central packing element 14 are shown in expanded configuration in engagement with the casing C. FIG. 2A also shows expansion of the slip element 40 as the lower cone 46 is shifted upwardly toward the upper cone 42. Packer 1 is shifted from the position of FIG. 1 to the position of FIG. 2 upon the application of tubing pressure. Tubing pressure is increased by use of a conventional tubing pressure ball which can be dropped into a conventional ball seat located below the packer to permit an increase in tubing pressure acting through port 26*e*. This increased pressure will shift piston 56 from the position shown in FIG. 1B upwardly to the position shown in FIG. 2B. Upward movement of piston 56 urges the lower cone 46 upwardly subjecting the slips and packing element assembly to axial compression. Retraction of the piston 56 is prevented by the ratcheting engagement between the piston threads on the piston 56*c* and the ratcheting body lock ring 52.

The packer shown in FIGS. 1 and 2 is a retrievable packer which can be disengaged from the casing and removed from the well. A conventional retrieving tool R shown in FIGS. 3A and 3B can be used to retrieve the packer from the well. Retrieving tool R comprises means such as collet 100 insertable and engagable with the lower end of releasing sleeve 60 located in the lower end of the packer 1. The retrieving tool can be inserted through the packer and upward movement will disengage releasing sleeve 60 from its position holding latch collet 58 in the position shown in FIG. 2B. The body 26 which is attached to the latch collet 58 is in tension when the packer is in the set position of FIGS. 2A and 2B. When the collet 58 is released by disengagement of releasing sleeve 60, collet 58 will cam inwardly thus permitting the inner mandrel or body 26 to be shifted upwardly by continued upward movement of the retrieving tool R. Upward movement of mandrel 26 moves the upper sub or setting sleeve 2 upwardly away from the packing element system to permit retracting of resiliently biased backup rings 6, 8, 20 and 22. As shown in FIG. 3A, the release of the axially compressive forces applied to the packing element system through the abutting shoulder of the upper sub or gage ring 2 and the abutting shoulder of the lower gage ring 24 does not necessarily result in complete retraction of the primary packing element 14 from engagement with the casing C, but does permit disengagement of the expandable extrusion preventing backup rings.

Figure 4A:
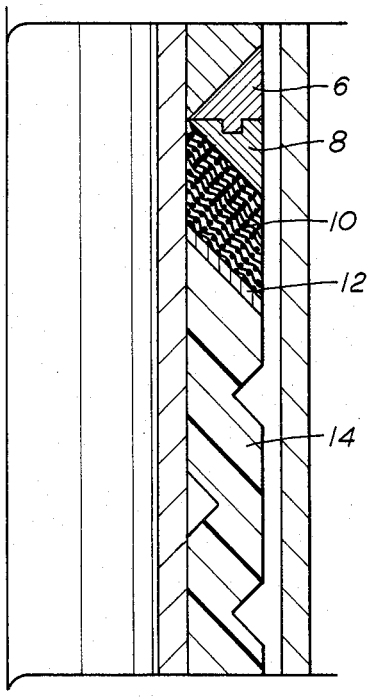
FIGS. 4A and 4B are sectional and plan views respectively of portions of the packing element configuration of the instant invention shown in the retracted position corresponding to FIGS. 1A and 1B.
Figure 4B:
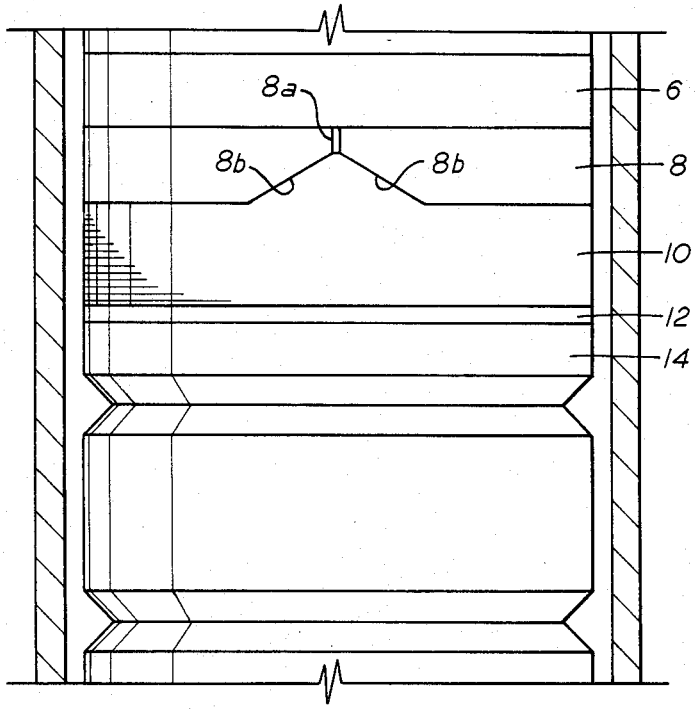
Figure 5A:
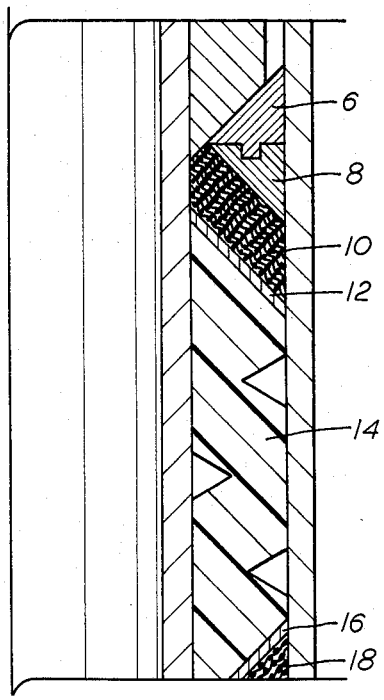
FIGS. 5A and 5B are similar cross-sectional and plan views of the packing element shown in FIGS. 4A and 4B in the expanded or set condition corresponding to that shown in FIGS. 2A and 2B.
Figure 5B:
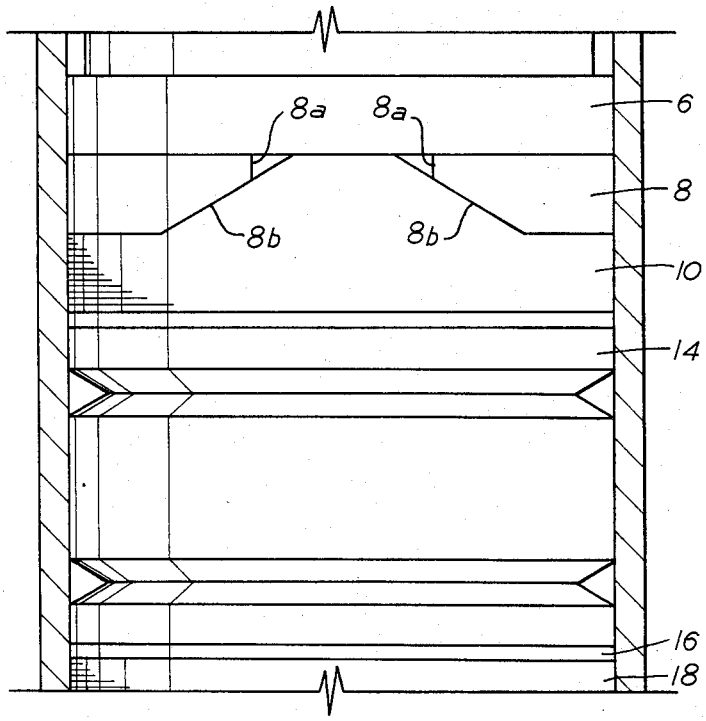
Figure 6A:
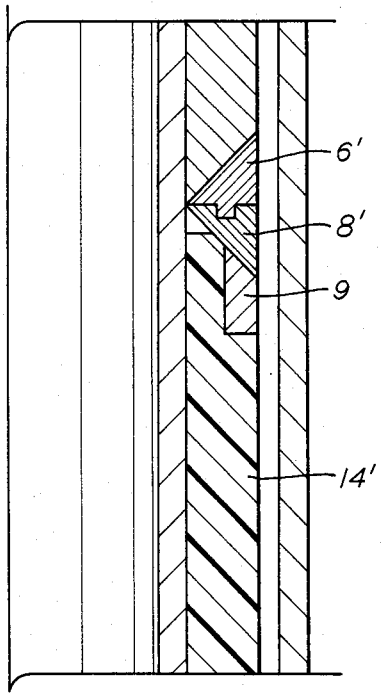
fig. 6A (PRIOR ART)
FIGS. 6A and 6B are cross-sectional and plan views respectively of a conventional packing element configuration employed on a conventional permanent packer.
Figure 6B:
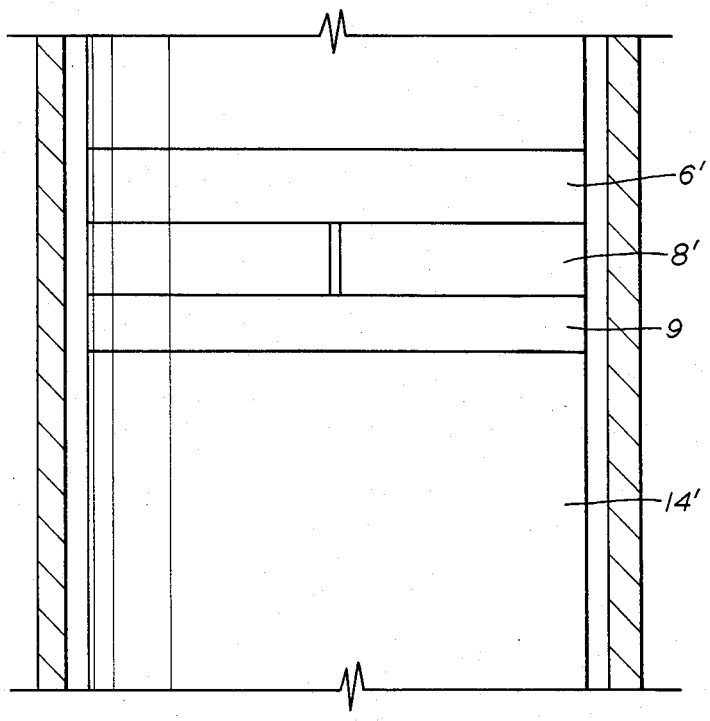
fig. 6B (PRIOR ART)

The action of the packing element system of the preferred embodiment of this invention is shown in greater detail in FIGS. 4A and 4B and in FIGS. 5A and 5B. FIGS. 4A and 4B show the packing element system in the relaxed configuration in which the interengageable upper extrusion preventing backup ring 6 and 8 are in the retracted position together with the remaining elements of the packing element system. The split 8*a* between opposite ends of annular backup ring 8 is shown in FIG. 4B. In the preferred embodiment of this invention, a tapered surface 8*b* is provided on the ends of the expandable backup rings adjacent the resilient wire mesh material 10. FIG. 5B shows the circumferential movement of the ends 8*a* of backup ring 8 upon radial expansion of the backup ring 6 and 8 when subjected to axial compression. The application of axial compressive loads results in expansion not only of backup ring 6 and 8, but also of the remaining elements comprising the packing element assembly. FIG. 5A shows that both the primary packing element 14 and the resilient barrier member 10, comprising wire mesh in the preferred embodiment of this invention, have been axially compressed and radially expanded. FIG. 5B shows that the axial compression and radial expansion of backup ring 8 and of the resilient barrier element 10 permits the resilient barrier element 10 to occupy the area between the expanded ends 8*a* of the backup ring 8. The tapered surfaces 8*b* provide a smooth transition to permit movement of the resilient mateial 10 into this gap. Note that the primary sealing element 14, although axially compressed and radially deformed, does not deform into the gap between opposed ends of the split backup ring 8. The resilient barrier element 10 is thus conformable to the contour of the radially expandable extrusion preventing rings 6 and 8 and to the primary and secondary packing elements 14 and 12. The barrier elements 10 are formed from a material which will not seize or grab the backup ring 8 when expanded. The expanded backup ring 8 can slide relative to the barrier element 10. A lower friction interface is established between the barrier element 10 and the expanded backup ring 8 than would exist between an expanded backup ring adjacent a deformable packing element exhibiting inelastic characteristics, and will permit radial contraction of the backup rings away from the inner wall of the conduit. A packing element system constructed in accordance with this invention has been shown to be retrievable even when subjected to a differential pressure in excess of 12,000 psi and a temperature of at least 350° F.

Figure 7A:
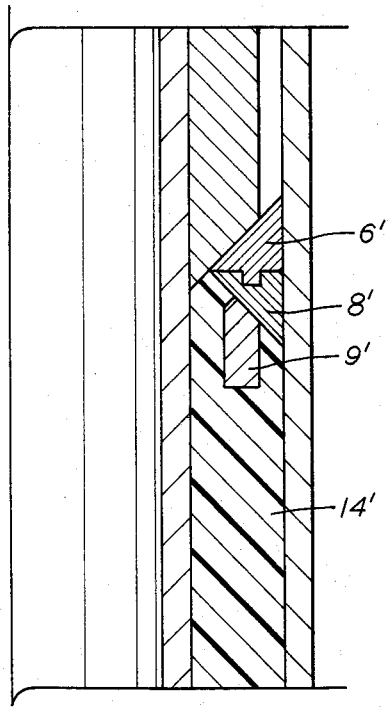
fig. 7A (PRIOR ART)
FIGS. 7A and 7B are cross-sectional and plan views of the packing element construction shown in FIGS. 6A and 6B in the expanded configuration in which the packing element establishes sealing integrity with the well casing.
Figure 7B:
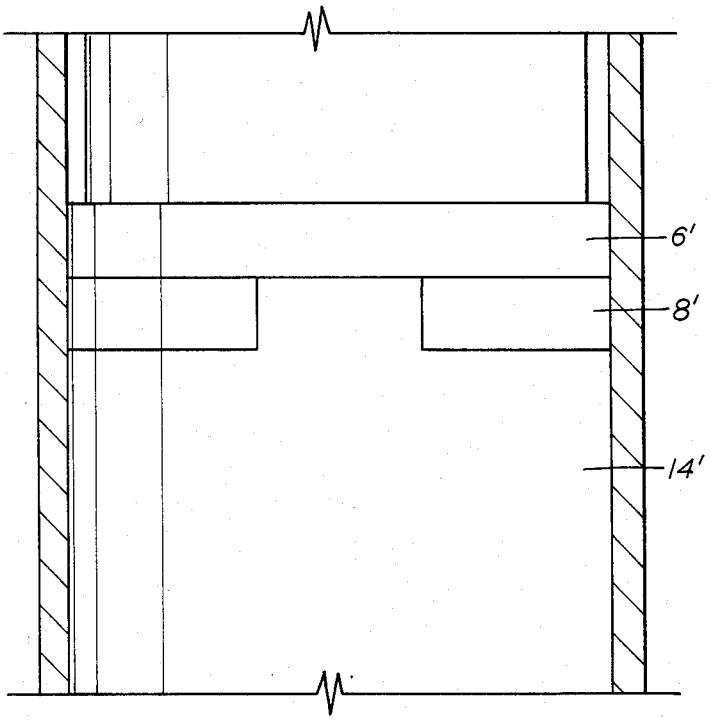
fig. 7B (PRIOR ART)
Figure 8A:
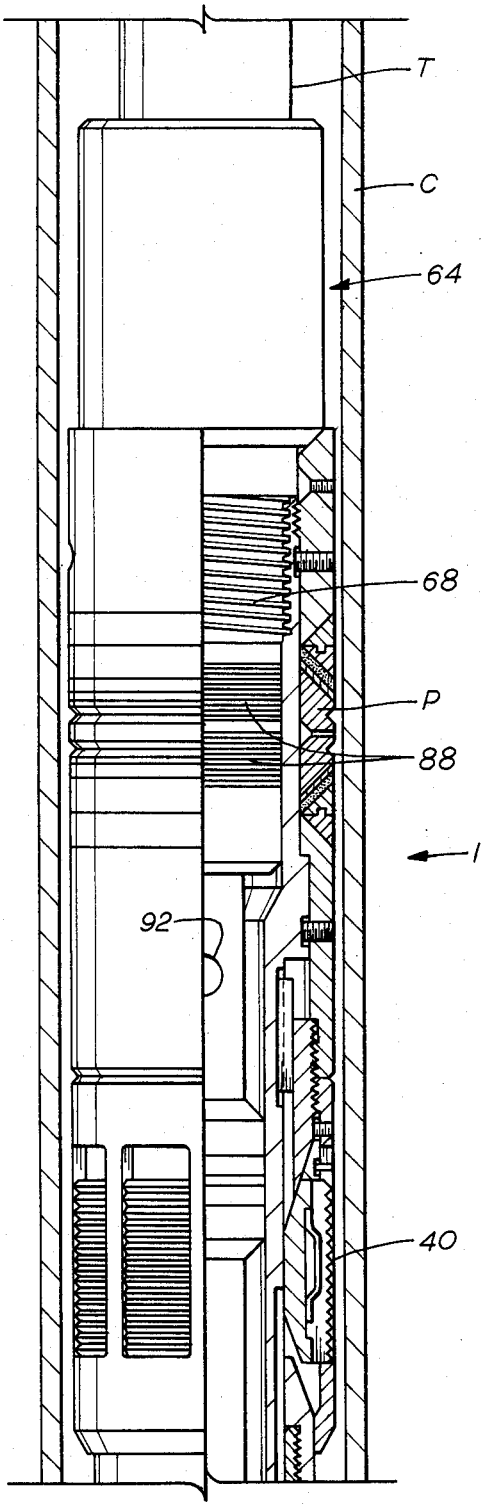
FIGS. 8A, 8B, 8C, 8D, 8E and 8F are views of a gravel packing assembly employing upper and lower retrievable packers in which the lower packer is set in engagement with well casing to establish sealing integrity therewith and the upper packer is shown in the retracted position.
Figure 8B:
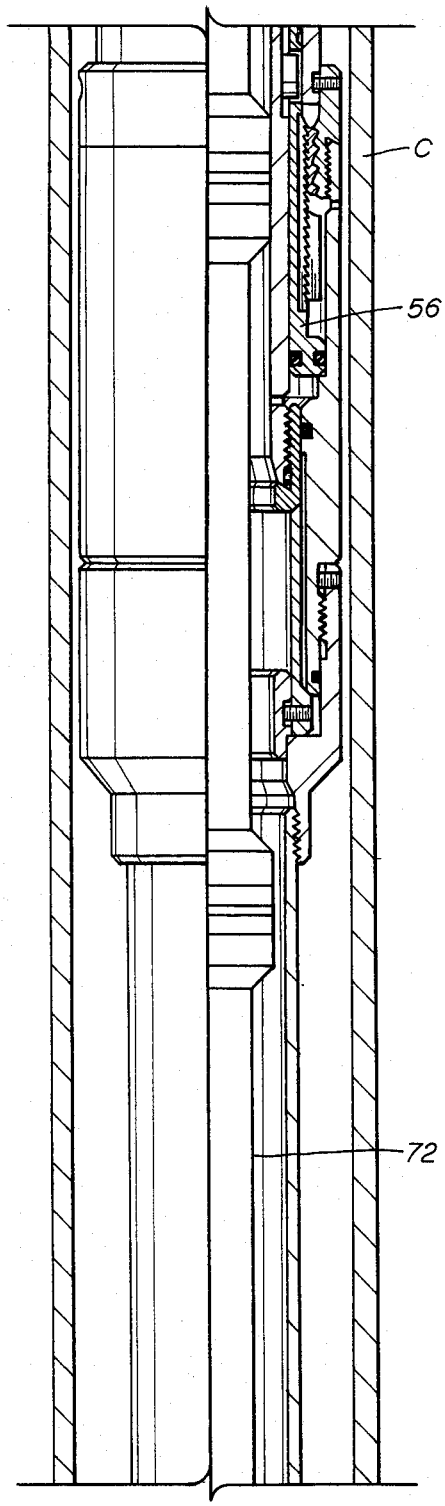
Figure 8C:
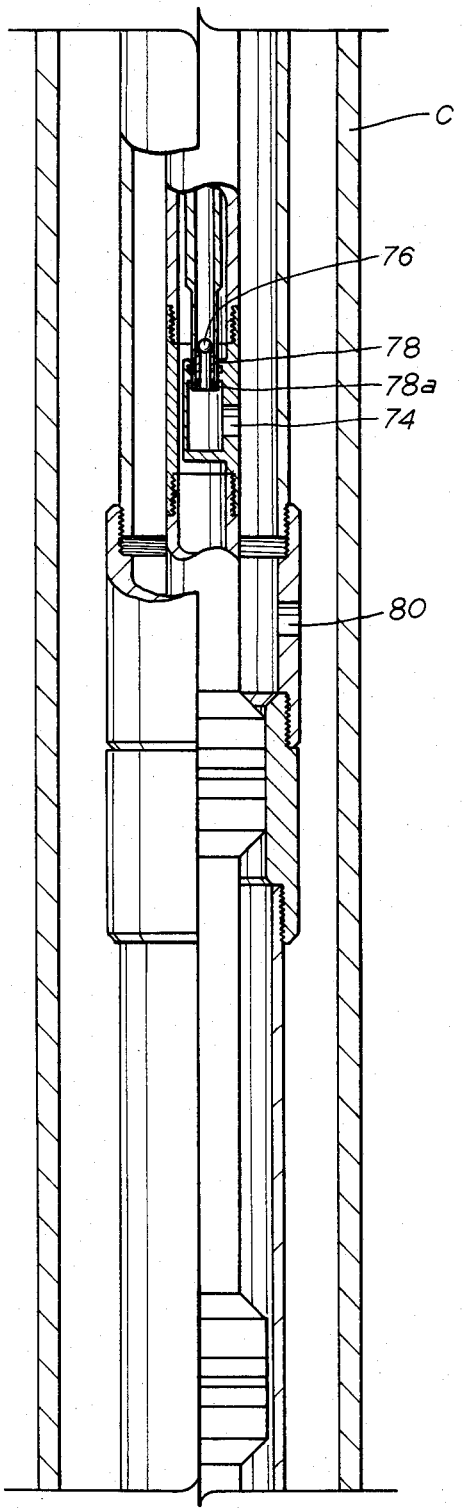
Figure 8D:
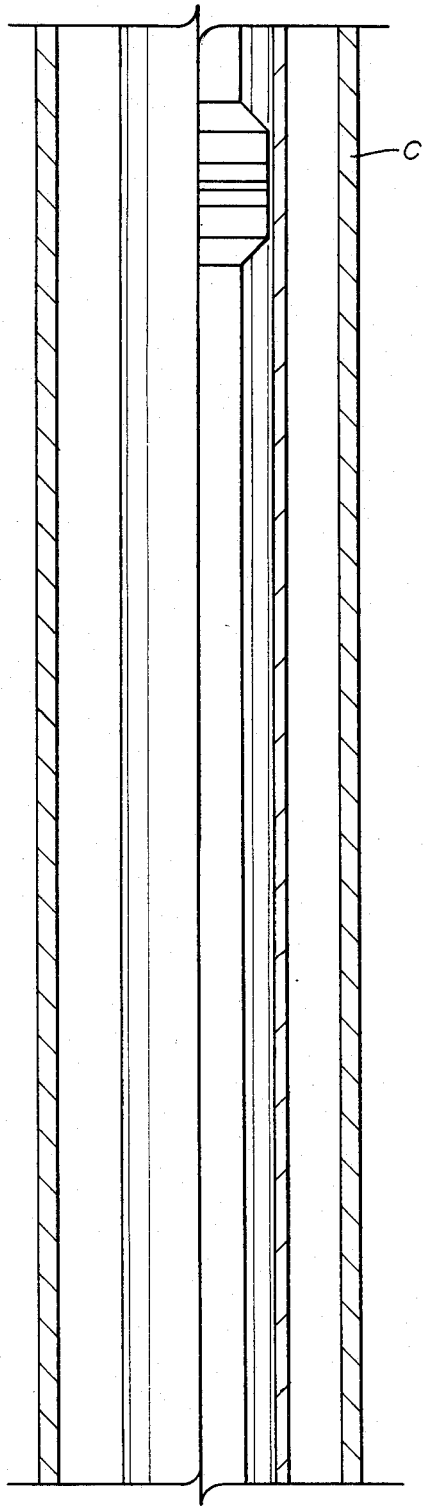
Figure 8E:
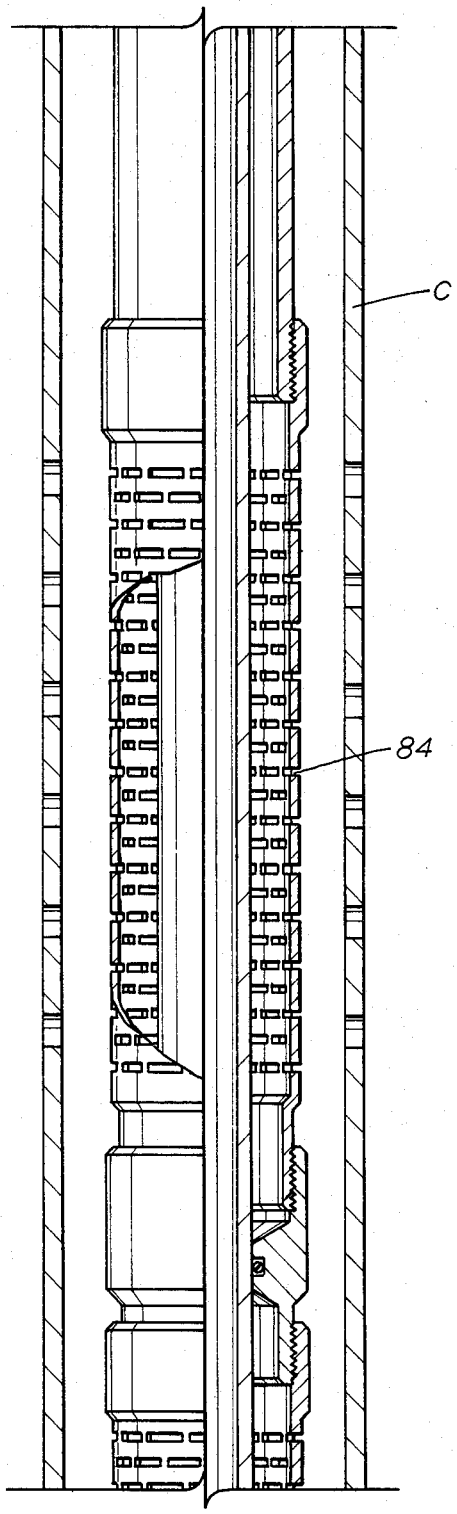
Figure 8F:
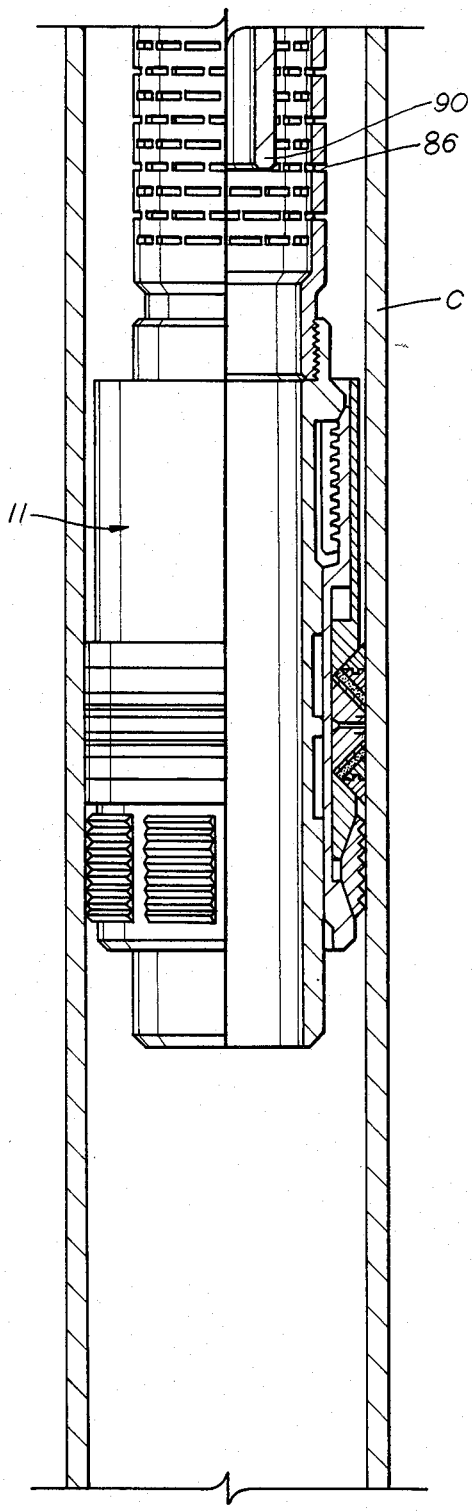

FIGS. 6A and 6B and 7A and 7B are similar to FIGS. 4 and 5, but illustrate the behavior of conventional packing element systems used on permanent non-retrievable packers and well tools. Complementary split extrusion backup rings 6' and 8', each having a triangular interfitting cross-section, are expandable into engagement with the outer casing in the same manner as the extrusion rings shown in FIGS. 4 and 5. The free ends of the inner extrusion ring 8' are, however, parallel and are not beveled in the same manner as free ends 8*b* of the retrievable configuration of FIGS. 4 and 5. Packing element 14' can comprise a conventional elastomeric packing element formed of a material, such as nitrile rubber or a thermoplastic packing element resistant to extreme temperatures and to corrosive materials and formed of a material such as polytetrafluoroethylene, commonly referred to under the DuPont trademark as Teflon. A metallic booster ring 9 is positioned between the expandable backup ring 6' and 8' and the conventional packing element 14'. As shown in FIGS. 7A and 7B, axial compression applied to the backup ring 6' and 8' into the primary packing element 14' results in radial expansion of each element into engagement with the outer casing.

When used in the conventional permanent packer, a seal system of the type shown in FIG. 7A and 7B provides excellent sealing integrity to isolate a portion of the well bore above the packing element from the well bore below the packing element. Ideally the elastomeric element 14' would be retractable from the configuration of FIG. 7B to the configuration of FIG. 6B. However, under practical operating temperature, pressure conditions and in the presence of well fluids, the packing element 14 is often permanently deformed and is incapable of returning to its initially retracted position. Over time, elastomeric packing element materials suitable for use in subterranean oil and gas wells take on a permanent set, thus losing their elastomeric and resilient properties. As shown in FIG. 7B, the conventional packing element system will tend to expand between the free ends of the extrusion barrier rings 8'. When the packing element system takes on a permanent set or is permanently deformed by disruption of the intermolecular structure as the material extrudes through the gap in backup rings 8 prime, the packing element 14' can no longer retract. The presence of the permanently deformed packing element material adjacent the extrusion backup ring 6' and 8' also prevents retraction of these metallic backup rings. Thus, even though axial compression is removed from the backup ring 6' and 8' and the principal packing element 14', the backup ring 6' and 8' cannot retract. These metallic rings engaging the casing thus prevent retraction of the packer or well tool. As best understood, the presence of the resilient element 10, comprising a wire mesh material in the preferred embodiment of this invention, between the radially expandable ring 6 and 8 and the principal packing element 14 permits retraction of the extrusion barrier ring 6 and 8, even when the primary packing element 14 becomes inelastic, has been permanently deformed and is incapable of retraction from its expanded position in engagement with the casing.

One or more packers employing the packing element system comprising the preferred embodiment of this invention can be used in gravel packing a well in the manner shown in FIGS. 8A–8F. Two packers 1 and 11 each identical in construction to the packers shown in FIGS. 1–3 can be employed in a configuration for gravel packing a well in one trip. Well packer 11 is shown in the set configuration below perforations in casings C communicating with the zone to be gravel packed. The one trip gravel packing assembly comprising an upper retrievable packer 1, a conventional crossover tool 72 and a conventional gravel packing screen 84 is suspended from the tubing T and can be lowered into the well. The upper packer 1 can be set in conventional hydraulic fashion by dropping a ball 76 into engagement with a ball seat 78. With ball 76 in engagement with a seat, pressure applied through the tubing T will shift piston 56 to expand slips 40 and the packing element system P including the backup rings 6 and 8, the intermediate resilient element 10 and the primary packing element 14, into engagement with the casing. Once the upper packer has been set, additional tubing pressure will shear a shear pin holding ball sleeve in place and will shift the ball sleeve thus permitting communication between the tubing T and radially extending port 74. The crossover tool 72 can then be disengaged from the upper set retrievable packer by rotating the tubing T to disengage threads 68. Upward movement of the tubing string and the attached crossover tool will shift seal 88 upwardly from the bore of the packer 1. With the gravel packing tool in the shifted configuration, a gravel packing slurry can be introduced through the tubing T and through the communicating port 74 and 80 into the annulus below the upper packer 1 and above the lower sump packer 11. Gravel can thus be deposited adjacent the perforations communicating with the production zone above lower sump packer 11. Fluid can then be circulated through the gravel packing screen 86, with gravel being deposited in the annulus adjacent screen 86 and fluid can then be circulated up the central pipe 90 around crossover port 74, out port 92 through the bore of packer 1 and around seal 88 which has been removed from the packer bore. The fluid can then return to the surface through the annulus surrounding tubing T.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications can be made without departing from the spirit of the described invention.

What is claimed and desired to be secured by Letters Patent is:

1. A retrievable well tool for use in maintaining sealing integrity between inner and outer concentric conduits under high temperature and pressure conditions in a subterranean well, the well tool comprising: an annular packing element at least partially plastically deformable at the well temperature and pressure, the packing element being initially radially expandable under axial compression; first and second relatively axially shiftable annular shoulders respectively disposed on opposite sides of said packing element, at least one of said shoulders being movable towards and away from the other shoulder; radially expandable, axially split backup rings between each shoulder and the packing element, the backup rings being radially expandable into abutment with the inner surface of the outer conduit upon movement of the first and second shoulders toward each other to compress the packing element, thereby opening an axial gap at the location of said axial split in each said backup rings; said axial split being defined by oppositely inclined surfaces facing said packing element; and a resiliently deformable barrier member disposed between each said backup ring and said packing element, said barrier members being resiliently deformable upon radial expansion and contraction of the backup rings, whereby said axial gaps in said backup rings adjacent the outer conduit are respectively sealed by expansion thereinto of portions of said barrier members; said oppositely inclined surfaces acting on said portions of said barrier elements to displace said portions from said axial gap and permit said backup rings to contract by movement of at least one of said annular shoulders away from the packing element, thereby permitting retrieval of the well tool.

2. The well tool of claim 1 wherein the annular barrier members comprise a metallic mesh having a low friction interface with said backup rings.

3. The retrievable well tool of claim 1 wherein the annular barrier member comprises a metallic mesh.

4. The well tool of claim 3 wherein the backup rings have greater resiliency than the packing element at the high temperature and pressure of the well.

* * * * *